United States Patent [19]

Lindblom

[11] Patent Number: 4,858,904

[45] Date of Patent: Aug. 22, 1989

[54] DEVICE FOR COMBINING PARTIAL PILES OF BOOK PAGES

[75] Inventor: Kurt L. Lindblom, Trollhattan, Sweden

[73] Assignee: Miller-Johannisberg Druckmaschinen GmbH, Weisbaden-Biebrich, Fed. Rep. of Germany

[21] Appl. No.: 180,292

[22] Filed: Apr. 11, 1988

[30] Foreign Application Priority Data

Apr. 11, 1987 [DE] Fed. Rep. of Germany ..... 3712387

[51] Int. Cl.[4] ..... B65H 39/02

[52] U.S. Cl. ..... 270/58; 198/374; 414/758

[58] Field of Search ..... 270/45, 46, 47, 52, 270/54–58, 59; 198/376, 374, 378, 404; 414/758, 763, 767

[56] References Cited

U.S. PATENT DOCUMENTS

| | | | |
|---|---|---|---|
| 3,070,211 | 12/1962 | Williamson | 270/58 |
| 4,135,619 | 1/1979 | Cerboni | 198/404 |
| 4,155,133 | 5/1979 | Timson | 270/54 |

FOREIGN PATENT DOCUMENTS

| | | | |
|---|---|---|---|
| 6548 | 1/1985 | Japan | 414/758 |
| 672938 | 5/1952 | United Kingdom | 270/58 |
| 1538066 | 1/1979 | United Kingdom | 270/58 |
| 1603401 | 11/1981 | United Kingdom | 270/58 |

*Primary Examiner*—Robert E. Garrett

*Assistant Examiner*—Therese M. Newholm

*Attorney, Agent, or Firm*—Carothers & Carothers

[57] ABSTRACT

The invention relates to a device for combining partial piles of book pages by laying one on another. The partial piles may be brought up alternately in an inclined position on a conveying chain. According to the invention, there is provided above the conveying chain a rotary rearranging apparatus. The rearranging apparatus carries a plurality of gripping systems each adapted to pick up one partial pile of book pages and, after rotation of the rearrangement apparatus through a 360 degree revoluion, deposits the partial pile of book pages beside an identical succeeding partial pile. During the 360 degree revolution of the rearranging apparatus, each gripping system is rotated about an axis parallel to the rotational axis of the rearranging apparatus such that the gripper systems continuously remain in an upright orientation with the grippers always projecting downwards at the lowest point of the gripping system. Before combination of any given partial pile of book pages with another partial pile, every such given partial pile may be rotated by the respective gripper system through 180 degrees about an axis extending at 90 degrees to the normal of the plane of the partial pile, and for this purpose every gripping system of the rearrangement apparatus is mounted so as to be rotatable about a vertical axis and, in a part of its orbital path of motion during the 360 degree revolution of the rearranging apparatus, is rotated through 180 degrees about this vertical axis.

11 Claims, 12 Drawing Sheets

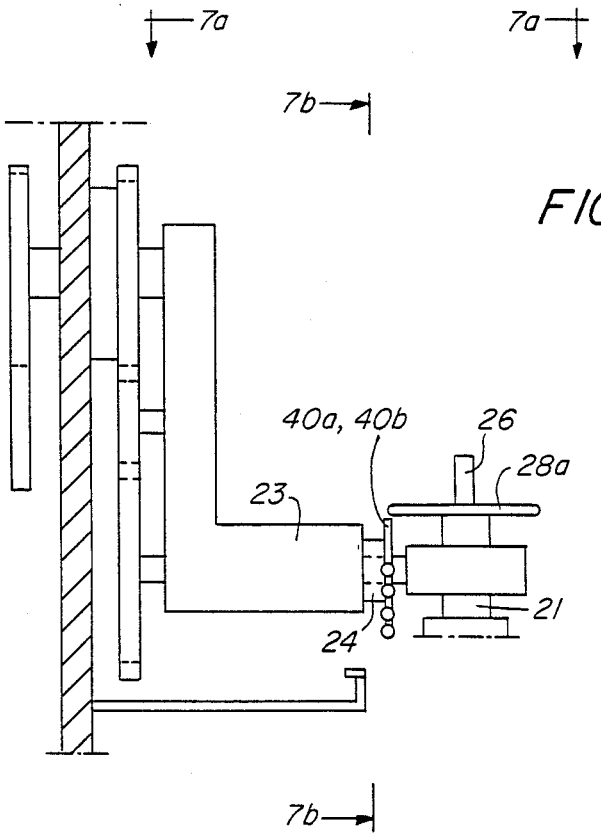
FIG. 7
FIG. 7a
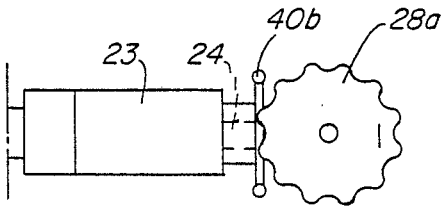
FIG. 7b
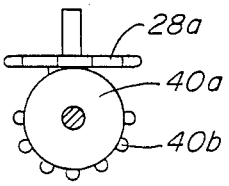

DEVICE FOR COMBINING PARTIAL PILES OF BOOK PAGES

BACKGROUND OF THE INVENTION

This invention relates to a device for combining partial piles of book pages by laying one pile on another. Such a device serves for combining partial piles of book pages of such type that each partial pile contains, for example, twice all the pages of a complete inner book or signature lying adjacent to one another. In the bookmaking art, the individual sheets of each partial pile or signature of a book bear, on either side thereof, single or multiple prints of two book pages lying opposite and laterally reversed to one another. The sheets of every partial pile collectively include book pages printed on one half of the pile of sheets in consecutively ascending page order and on the other half of the same pile of sheets in descending order. The partial piles are combined with one another to produce multiple signatures. However, before being combined, one of each pair of partial piles to be combined must first be rotated around through 180 degrees about an axis at 90 degrees to the normal of the plane of the pages. After assembly the entire block of sheets are then cut through the middle so that two complete signatures in proper page order are obtained. If the sheets of each partial pile contain multiple prints of the respective pages (for example, two prints) an additional cutting operation produces four signatures from the single assembly of two partial piles.

The construction of a known device for handling such partial piles in such that each partial pile having similarly oriented pile sheets is assigned to a depot and one of a pair of conveyer systems is designed to turn a partial pile through 180 degrees in the plane in which it lies while another conveyer runs parallel to the characterized one conveyer and in the same direction of motion in the region where two partial piles carried by the two conveyers are combined to form one pile. That is, one of the two conveyer system effects a turn through 180 degrees and is guided in a plane which runs parallel and adjacent to the plane of the other conveyer system. A plough-like device is provided for combining respective pairs of partial piles carried by the two conveyers.

BRIEF SUMMARY OF THE INVENTION

It is an object of the invention to provide an apparatus which performs the same task as above described in reorienting partial piles of book pages prior to assembly thereof to form signatures, the apparatus of this invention being more simply constructed and, in particular, not requiring two depots and two conveyers as in the prior art.

The device according to this invention also, through special modification, is suitable for combining two partial piles either with or without planer rotation of every second partial pile, depending on the kind and arrangement of the printed sheets in the partial piles. In addition, the amount of space occupied by the device of this invention is reduced and the necessity for special folding apparatus, as required in the prior art, is also obviated.

According to this invention, there is provided above a conveyer system, which takes the form of a single conveyer chain with serial carriers, a rearrangement apparatus which is rotatable on a horizontal axis of rotation that extends generally perpendicular to the direction of movement of the conveyer chain. The rearrangement apparatus is driven in syncronism with the running speed of the conveyer chain and carries, evenly distributed on a given circumference thereof, a plurality of pincer-like gripping systems for gripping and carrying one partial pile each so that each gripping system picks up one partial pile from the conveyer and, following a revolution of the rearrangement apparatus through 360 degrees, deposits the partial pile beside a succeeding partial pile brought up by the conveyer, and releases it. During rotation of the rearrangement apparatus, every gripping system is rotated about an axis parallel to the rotational axis of the rearrangement apparatus by a gear unit which is geared to the rearrangement apparatus with a transmission ratio of 1:1. The grippers of each gripping system thus always remaining projecting downwards at the lowest part of the gripping system.

As an example of such gearing, a planetary gear unit is contemplated which comprises a fixed sun gear, and intermediate gear carried by each gripping system which revolves about the axis of the sun gear, and a planet wheel mounted on the arbor around which each respective gripping system of the rearrangement apparatus is rotatably supported, the number of teeth on the sun gear being equal to that on all the planet wheels in order to achieve the desired 1:1 transmission ratio.

Where using this device to combine partial pages of the kind specified above, it is necessary that every partial pile handled by the rearrangement apparatus, before being combined with another partial pile, be rotated through 180 degrees about an axis extending perpendicular to the normal of the plane of the pile of pages. In this case the device is further modified such that every gripping system of the rearrangement apparatus, which acts in one preferred embodiment as a turning drum, is mounted to or in the rearranging apparatus so as to be rotatable about a vertical axis. Preferably, in the upper part of its rotary path of motion with the rearrangement apparatus, each gripping system is rotated through 180 degrees about this vertical axis. The rotation of each gripping system can be accomplished through a friction wheel drive that is connected to it and cooperates with a stationary friction rail, the latter being provided preferably in the upper part of the path of the orbital motion of each gripping system. The friction wheel, together with the gripping system attached to it, is rotated as it runs over the stationary friction rail. In order to ensure the rotation of each gripping system through exactly 180 degrees, the two positions of the gripping systems, offset by 180 degrees from one another, are fixed by a catch means.

To accommodate those instances where such a device is to utilized with partial piles that are not to be rotated through 180 degrees before combining, the friction rail is selectively shiftable to a non-contact position in which the friction wheels of the respective gripper systems do not engage it.

Due to geometric factors, such friction wheel drive can extend only over a relatively small angle of the rearrangement apparatus circumference. The result is, particularly with faster operation of the device, that the partial piles must be rotated through 180 degrees abut the vertical axis very quickly. This may lead to disturbing vibratory or fluttering movements of the partial piles. Moreover, such frictional gear units are subject to wear and tear caused by transverse shifting movements occurring perpendicular to the direction of frictional pull during engagement with the friction rail.

According to the invention, therefore, the frictional gear unit can be replaced by a positive locking movement transmission gear, for example by way of a lantern gear. This is designed such that the rotation of each gripping system about its respective vertical axis is effected through an output gear that is connected to the gripping system and is provided with arc-shaped recesses having a relief angle greater than 180 degrees which serve to engage the cylindrical lantern pinions of a lantern pinion driving gear having the lantern pinions distributed over 180 degrees of its circumference. The driving gear is mounted on a spindle connecting the gripping system to the planet wheel.

In this case also, in order to ensure rotation of each gripping system through exactly 180 degrees, the two positions of the gripping system, displaced by 180 degrees from one another, can be fixed by catches. In order to prevent rotation of the partial piles in applications where the piles should not be rotated before assembly, the lantern pinion driving gear is expediently mounted on the carrying spindle so as to be selectively shiftable axially such that its lantern pinions will not be engaged by the recesses in the side gear.

On practical grounds it has been found particularly expedient to provide the rearrangement apparatus with three gripping systems uniformly distributed at a given circumference. It is also expedient to slightly increase the circumferential speed of the gripping systems over the running speed of the conveyer chain by increasing the diameter of their orbit above the theoretical diameter. Thus, disturbing interactions are avoided between the partial piles and the carriers of the conveyer chain as the piles leave or enter the conveyer guide channel.

These and other objects and advantages of the invention will be more readily understood upon consideration of the following detailed description and the accompanying drawings which illustrate, in part rather schematically, an exemplary embodiment of the invention, and in which.

Figure 4A:
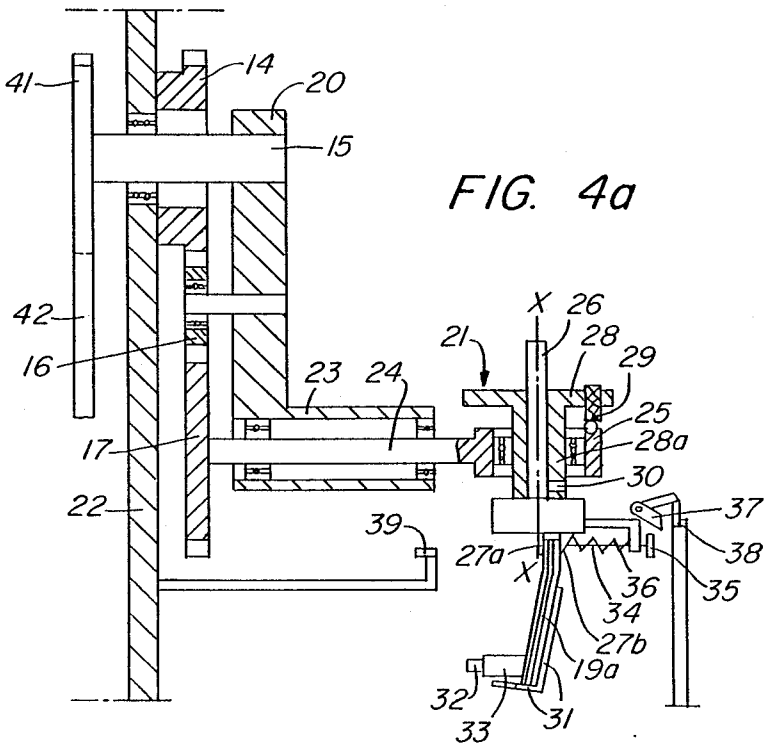
Figure 4:
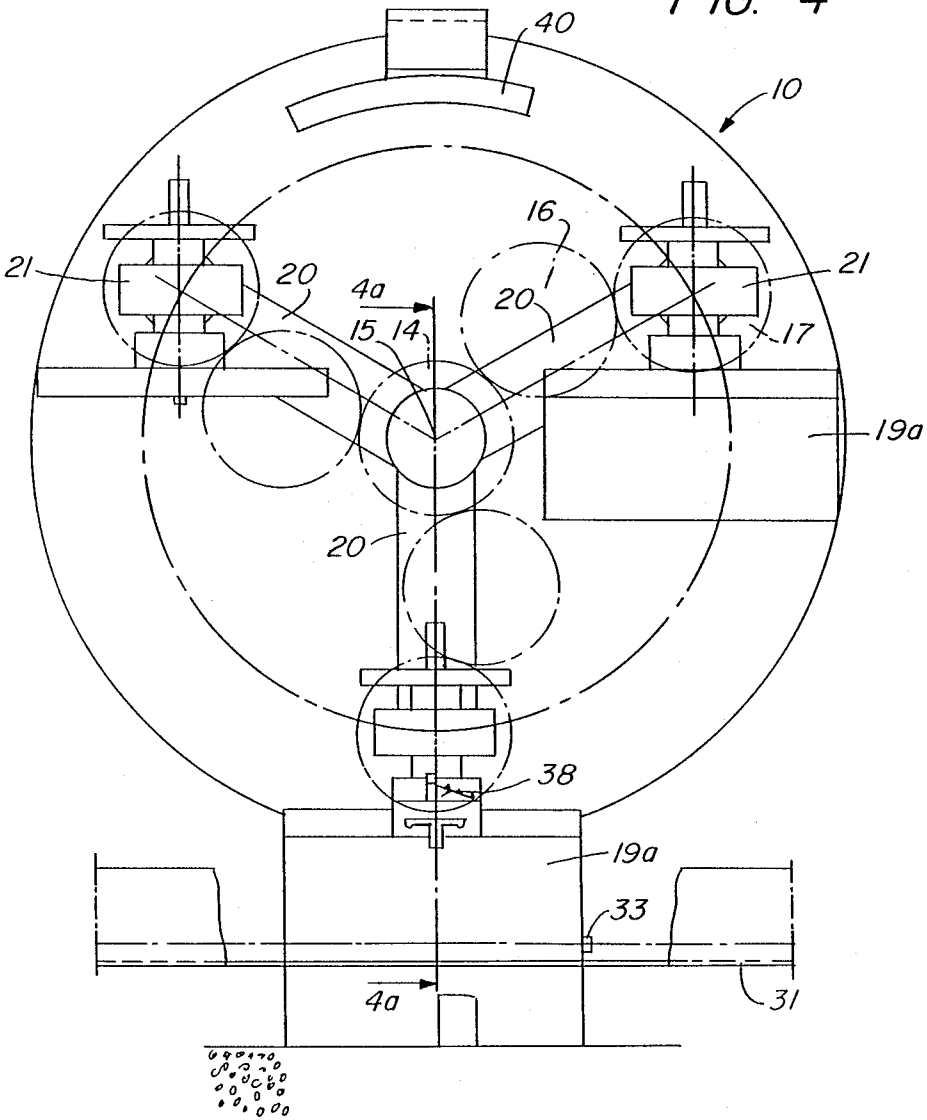
Figure 5A:
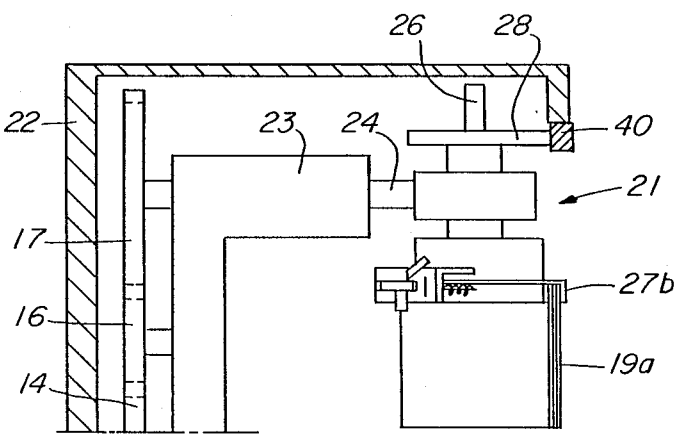
Figure 5:
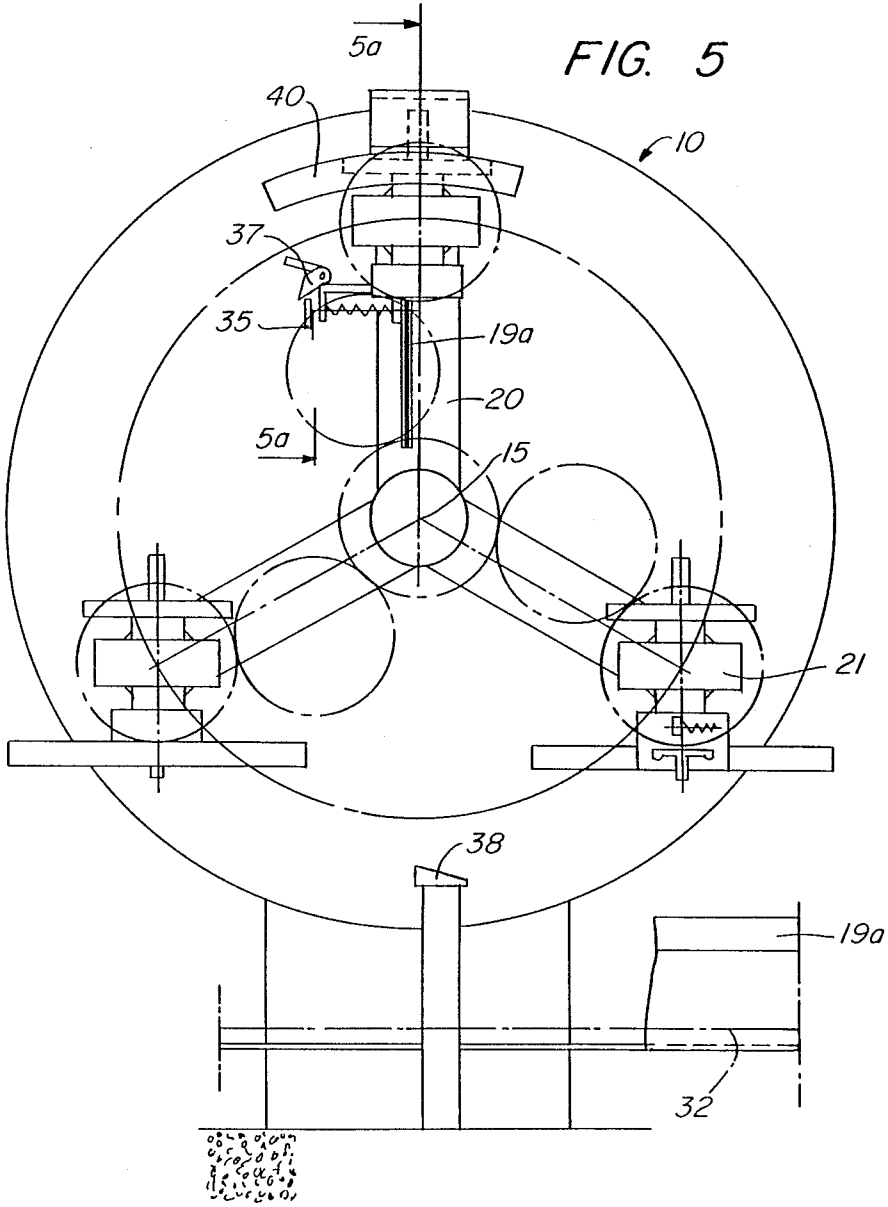
Figure 6A:
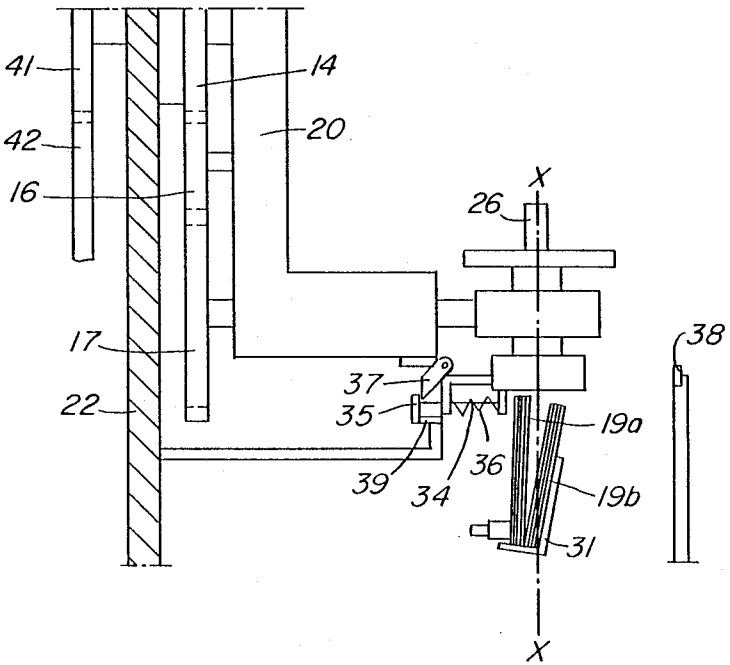
Figure 6:
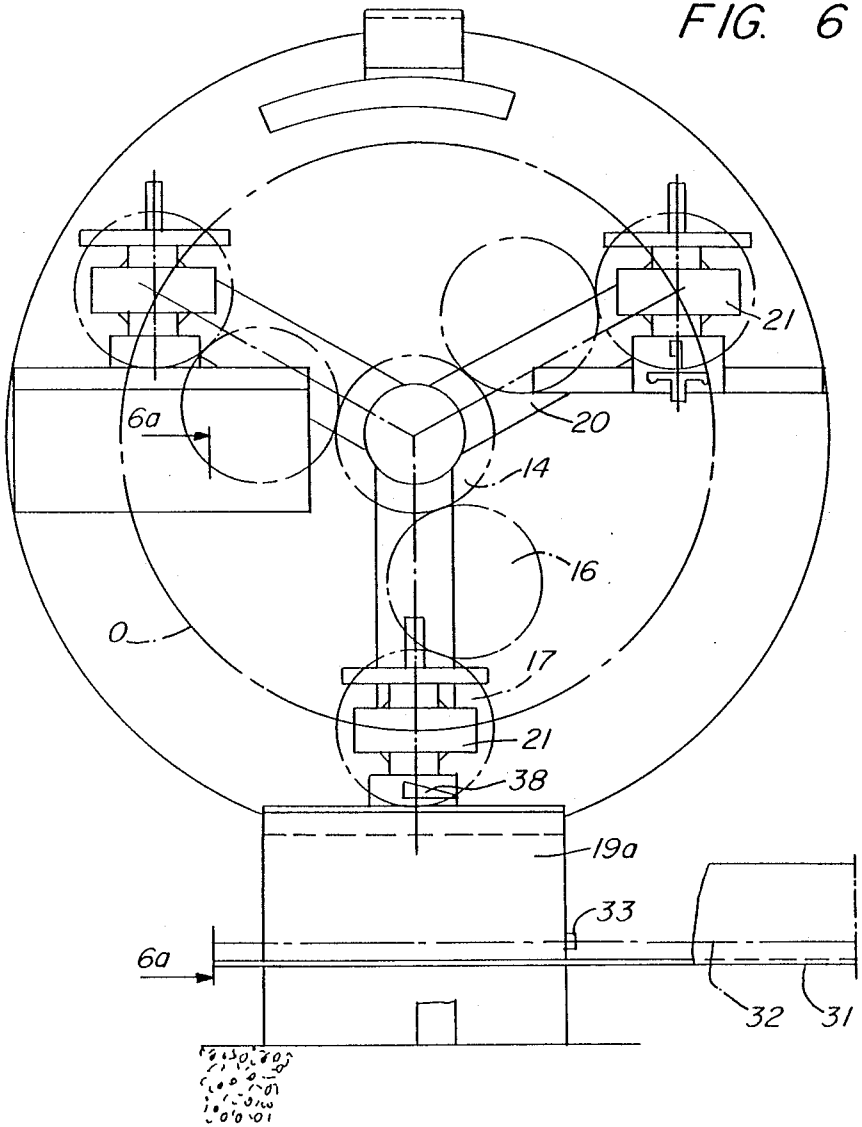

FIG. 4*a* is a section along line 4*a*—4*a* of FIG. 4;

FIG. 5*a* is a section along line 5*a*—5*a* of FIG. 5;

FIG. 6*a* is a section along line 6*a*—6*a* of FIG. 6;

FIG. 7 shows in the same manner as FIG. 6*a* a lantern pinion transmission gear used in place of the friction wheel;

FIG. 7*a* is a top plan view of FIG. 7 taken in the direction of view lines 7*a*—7*a* of FIG. 7; and FIG. 7*b* is a section along line 7*b*—7*b* of FIG. 7.

In all the figures of the drawing like parts are designated by like reference characters while parts which operate similarly are given the same reference character with the addition of letters such as a and b, etc., respectively. Further, the directions of rotation of most of the revolving parts as well as the directions of movement of the linearly moving parts are indicated by arrows.

Figure 1:
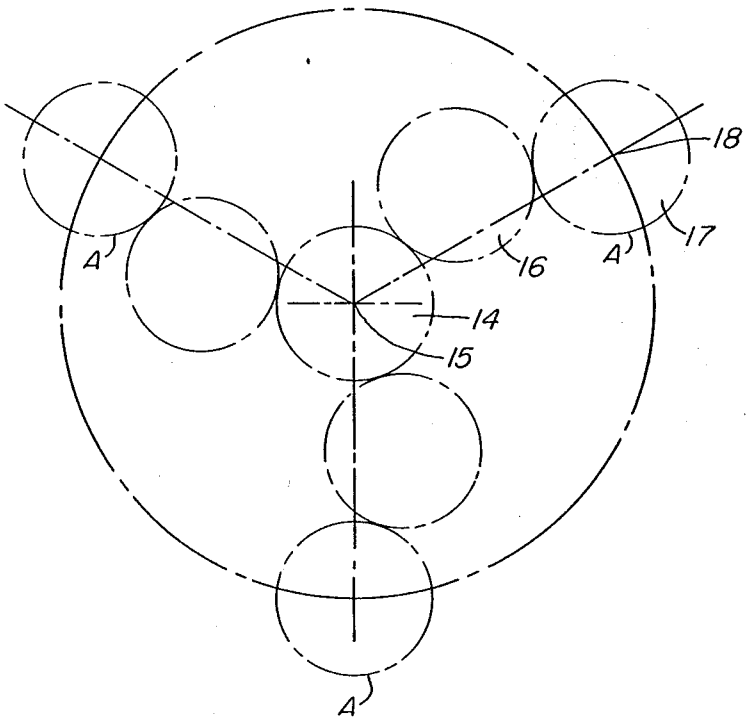
FIG. 1 is a kinematic front view of the overall rearrangement or turning apparatus and of the motion producing gearings therefor.

The gearing illustrated in FIG. 1 shows a stationary sun gear 14; three intermediate gears 16, one for each of three gripping systems (not shown) revolving in engagement with sun gear 14 around central axis 15; and three respective planet wheels 17 which serve to drive the three gripping systems. The number of teeth on the sun gear 14 is the same as that on planet wheels 17 whereby the location of the pincer or pile suspension apparatus of the gripper systems, indicated by A, always remains at the lowermost point of the gripping systems. The respective rotational axes 18 of the gripping systems, and thus of the planet wheels 17, are parallel to central axis 15.

Figure 2:
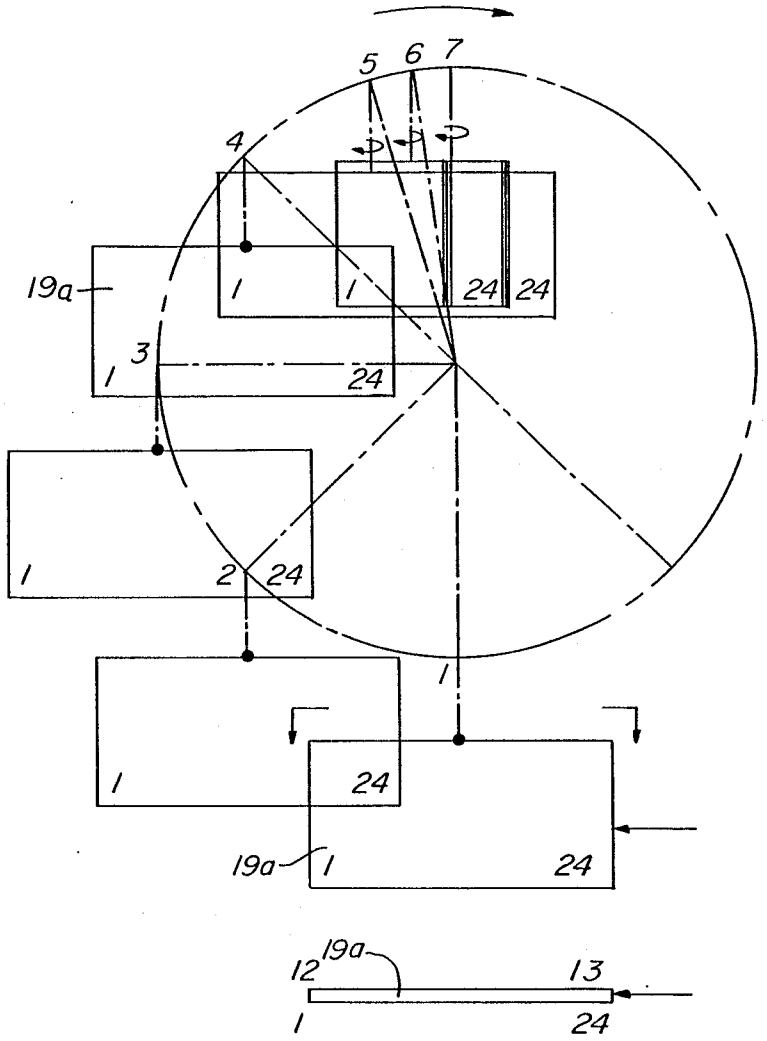
FIGS. 2, 3, 4, 5 and 6 show different working positions and function positions of the rearrangement apparatus.

Operation of the invention is shown in FIG. 2, wherein during rotation of the rearrangement apparatus a partial pile of book pages 19*a* is picked up by one of the gripping systems at point 1, when the partial pile arrives there with a velocity determined by the conveyor which carries it. While moving in orbital motion with the rearrangement apparatus through points 2, 3 and 4, the partial pile 19*a* remains in the vertical position in which it was picked up. On reaching point 5, the partial pile begins its rotation around a vertical axis. This rotation continues through point 6 up to point 7 in the orbital travel of the gripping system, by which time a rotation through 90 degrees has been completed.

In the first partial pile 19*a*, shown at the bottom of FIG. 2, the sheet on one side of the pile is printed on its exposed side with the book pages 1 and 24, and the exposed surface of the sheet on the other side of the partial pile is printed with pages 12 and 13. The intermediate sheets in the pile are printed with the intervening pages, in sequence. During transport of partial pile 19*a* between points 1 and 5, the side printed with pages 1 and 24 faces to the front (i.e. it faces the viewer of FIG. 2).

Figure 3:
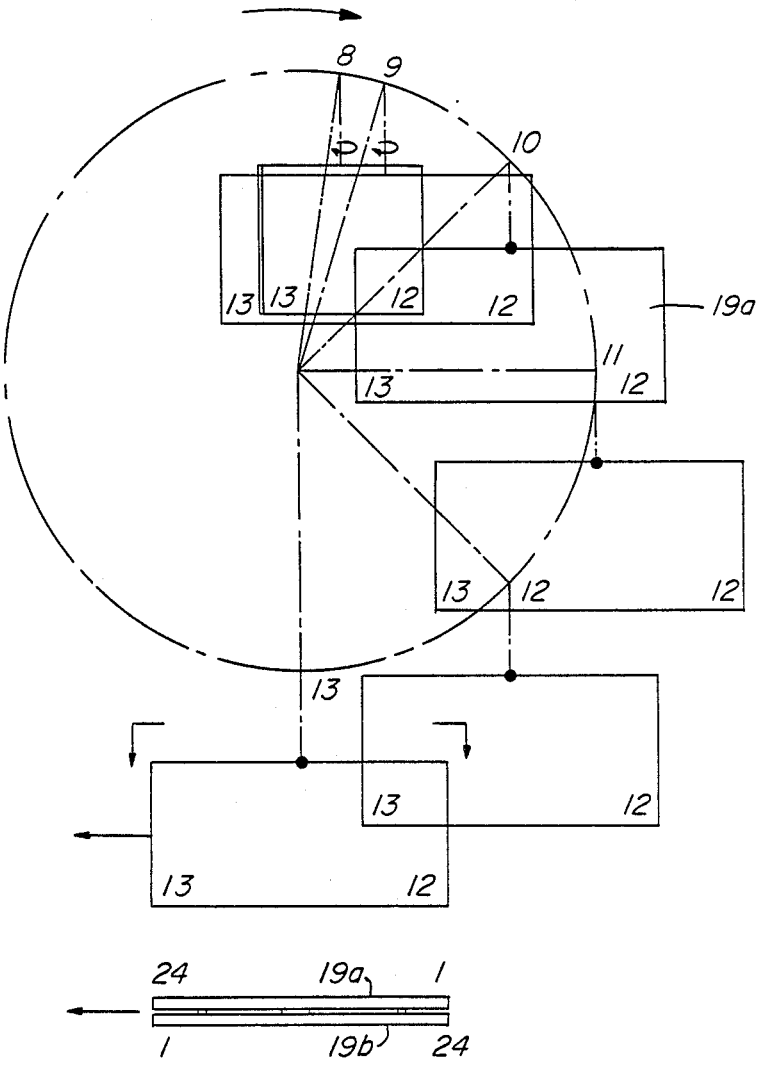

From FIG. 3 it can be seen that the partial pile 19*a* has been rotated further at point 8, and at point 9 has completed its rotation about a vertical axis through 180 degrees. Thereafter the partial pile 19*a* moves past points 10 and 11 arrives at end position 12 with the book pages 12 and 13 facing to the front. On reaching point 13, a second partial pile 19*b* has been moved by the conveyer chain under the rearrangement apparatus, and the rotated partial pile 19*a* carried by the rearrangement apparatus is laid upon partial pile 19*b* so that the final position or orientation of the two partial piles 19*a* and 19*b* shown at the bottom of FIG. 3, is achieved. When these two partial piles lying one on top of the other are cut transversely through the middle, two complete inner books or signatures, each consisting of pages 1 through 24 in sequence are produced.

FIGS. 4 and 5 show the rearrangement apparatus 10 as comprised of three brackets 20 rigidly connected to one another, which brackets are rotatable together about the central axis 15. Each of the brackets 20 carries a gripping system 21. In the position shown in FIG. 4 a gripping system is just about to pick up a partial pile 19*a*. One gripping system 21 is empty. The third gripping system 21 carries a partial pile 19*a* which has already been rotated through 180 degrees about a vertical axis on its way to the releasing thereof.

In FIG. 5 a partial pile 19*a* in a gripping system 21 located at the top of rearrangement apparatus 10 has just been rotated through 90 degrees about a vertical axis. Another of the gripping systems 21 is on the way to pick up a partial pile 19*a* which is approaching the rearrangement apparatus on a carrier carried by a conveyer chain 32. In the position shown in FIG. 6, one partial pile 19*a* is in the depositing position adjacent conveyer chain 32 and a further gripping system 21 is descending along an orbital path O on the way to pick up a partial pile from conveyer 32.

As can be seen especially in FIG. 4*a*, every bracket 20 is mounted in a rigid frame 22 so as to be rotatable about the central axis 15. The stationary sun gear 14 is also mounted on frame 22. The intermediate gears 16 are rotatably mounted to each respective bracket 20. A spindle 24 which is rotatable about a horizontal axis is mounted by means of two bearings in a pipe-shaped casing part 23 of bracket 20. In the head 25 of spindle 24 is mounted a spindle 26 which carries the actual grippers **27*a* and 27*b* mounted so as to be rotatable about a vertical axis X—X. Spindle 26 also carries a friction wheel 28 adapted to be latched onto head 25 in two positions of rotation displaced by 180 degrees from one another by means of spring ball catch 29. More precisely, the spindle 24 is not directly supported in head 25, but rather by way of a collet-like socket 28*b* which is integral with the friction wheel 28 and in which the spindle 26 is fixed by means of a binding or set screw 30 such that spindle 36 can be shifted vertically into whatever position is needed for adaptation to different heights of partial piles 19*a***.

Numeral 31 denotes the L-shaped guide channel for the partial piles **19*a* and 19*b*. Through guide channel 31 runs the conveyer chain 32 which is provided with carriers for the partial piles 19*a* and 19*b***.

While one of the grippers, **27*a* for example, is stationary, the other gripper 27*b* is movable for opening and closing purposes. To effect opening and closing, the movable gripper 27*b* is mounted on a spindle 34 with a head 35. Spindle 34 is surrounded by a pretensioned spring 36. In order to accomplish the opening or closing of gripper 27*b*, a cam actuated angled lever 37** is provided which, as shown in FIG. 4*a*, works in conjunction with a closing cam 37 such that it releases head 35 thus allowing the compression spring 36 to bias gripper **27*b* toward gripper 27*a* and thereby grip the partial pile 19*a* therebetween. As the opening cam 39** (FIG. 6*a*) comes into operation, the angled lever 37 is guided to reach behind the spindle head 35 and pull back the spindle 34, together with gripper **27*b* rigidly connected to it, against the bias of compression spring 36, thus opening the grippers and releasing the partial pile 19*a***.

The rotation of every partial pile **19*a* about a vertical axis is accomplished through the friction wheel 28 cooperating with a stationary friction rail 40** (FIG. 5*a*) provided in the upper part of the rotational path of the gripping systems 21. If sometimes the partial piles **19*a* are to be set down without having been rotated through 180 degrees about a vertical axis, friction rail 40 can be movable to a position out of the path of the friction wheels 28 (not shown) where the friction rail does not engage friction wheels 28** in their orbital travel.

As can be seen in FIG. 4*a* and particularly in FIG. 6*a*, the gripping surface of the fixed gripper **27*a* is slightly offset laterally from the vertical rotational axis x—x of the gripping system in order to make possible the trouble-free setting down of the partial pile 19*a* beside a partial pile 19*b* in the L-shaped guide channel 31**. That is, upon rotation upon axis X—X, the partial pile is also moved laterally from one side to the other side of axis X—X.

The actuation of the central spindle 15 of the brackets constituting the rearrangement apparatus is effected (see FIG. 4*a*) by a cog wheel 41 mounted on the spindle 15 and driven by a drive cog wheel 42.

In FIGS. 7, 7*a* and 7*b* a lantern pinion gear wheel **40*a*, which has lantern pinions 40*b* distributed over 180 degrees of its circumference, is non-rotatably fixed to spindle 24 which carries the gripping system 21 and connects the same with the planet wheel 17. The spindle 26 bearing the gripping system 21 carries an output gear 28*a* that is provided with arc-shaped recesses whose relief angle is greater than 180 degrees; these recesses serve to engage the cylindrical lantern pinions 40*b*. As the lantern pinions 40*b* of the lantern pinion driving gear 40*a* engage the recesses on the output gear 28*a*, the gripping system 21 is rotated through 180 degrees about a vertical axis X—X one during every revolution or orbit of the gripping system 21. By means of catches, similar to catches 29** as shown in FIG. 4*a* for example, the two rotary positions of gripping system 21, displaced by 180 degrees from one another, can be fixed firmly and precisely in the same manner as described above in connection with the friction wheel gearing.

It will be seen from the above description that I have invented a novel and improved apparatus for rearranging partial piles of pages from which book signatures are produced. Of course, I have contemplated various alternatives and modified embodiments apart from those above disclosed, and such would certainly also occur to others versed in the art once apprised of my invention. Accordingly, it is my intent that the invention be construed broadly and limited only by the scope of the claims appended hereto.

I claim:

1. In a device for combining two partial piles of book pages by laying one pile on the other, which partial piles are brought up alternately along a guide channel by a conveying chain (32) having carriers, the combination comprising:

a rearranging apparatus (20) which is rotatable about a horizontal central axis (15) that extends generally transversely to the direction of movement of the conveying chain (32), the rotational speed of said rearranging apparatus being synchronized to the running speed of the conveying chain (32);

said rearranging apparatus including a plurality of gripping systems (21) evenly distributed over an outer circumference thereof;

each said gripping system (21) being adapted to pick up one partial pile (**19*a*) and to carry the same through a 360 degree revolution of said rearrangement apparatus (20) about said central axis (15) and to deposit the same beside a succeeding partial pile (19*b*) and release it; and each of said gripping systems (21) being rotatable during revolution of said rearrangement apparatus by a transmission unit (14, 16, 17) with a drive ratio of 1:1 about an axis (28) which extends parallel to the central axis (15) of said rearrangement apparatus (20) such that pincer-like grippers (27*a*, 27*b*) of said gripping systems (21) always remain projecting downwards at the lowest part (A) of the respective gripping systems (21**).

2. The combination as claimed in claim 1 for combining partial piles of book pages, each of which contains at least twice all the pages of a complete inner book lying adjacent to one another, the individual sheets of the partial piles bearing on either side prints of two book pages lying opposite and laterally reversed to one another and every partial pile including book pages printed on one half of the sheet in consecutively ascending page order and on the other half in consecutively descending order, and every second partial pile before the combining thereof with another partial pile being first rotated through 180 degrees and wherein each said gripping system (21) of said rearrangement apparatus (20) is mounted with respect to said rearrangement apparatus (20) so as to be rotatable thereby in conjunction with revolution of said rearrangement apparatus (20) about said central axis (15) such that the gripping systems (21) are rotated bout a vertical axis (26) through 180 degrees of rotation about said vertical axis (26) with each 360 degrees revolution of said rearrangement apparatus (20).

3. The combination as claimed in claim 2 wherein rotation of said gripping system (21) about said vertical axes (26) occurs in the upper part of the orbital motion of each respective said gripping system (21) during revolution of said rearrangement apparatus (20).

4. The combination as claimed in claim 3 where each said gripping system (21) is driven in rotation about said vertical axis (26) through a respective friction wheel drive (28) that is connected to the respective said gripping system (21) and is cooperable for driving engagement with a stationary friction rail (40).

5. The combination as claimed in claim 3 wherein each said gripping system (21) is driven in rotation about said vertical axis (26) through a respective output gear (28*a*) which is connected to it and is provided with arc-shaped recesses having a relief angle greater than 180 degrees which serve to engage cylindrical lantern pinions (40*b*) of a lantern pinion driving gear (40*a*), said lantern pinions (40*b*) being distributed over 180 degrees of the circumference of said driving gear (40*a*), said driving gear (40*a*) being mounted on a spindle (24) which connects the respective said gripping system (21) to a planet wheel (17) of transmission unit (14, 16, 17).

6. The combination as claimed in claim 3 wherein two positions of each said gripping system (21), displaced by 180 degrees from one another, are defined by catch means (29).

7. The combination as claimed in claim 4 wherein said friction rail (40) is adapted to be shifted into a non-engaged position out of contact with said friction wheels (28) of the respective said gripping systems (21).

8. The combination as claimed in claim 5 wherein said lantern pinion driving gear (40*a*) is adapted to be shifted axially along spindle (24) such that lantern pinions (40*b*) will not engage said recesses in said output gear (28*a*).

9. The combination as claimed in claim 1 wherein said rearrangement apparatus (20) includes three of said gripping systems (21).

10. The combination as claimed in claim 1 wherein the orbital speed of said gripping systems (21) is increased slightly over the running speed of said conveying chain (32) by increasing the diameter of the orbit of motion for said gripping systems (21) above the theoretical diameter therefor.

11. The combination as claimed in claim 1 wherein said pincer-like grippers (27*a*, 27*b*) are adapted to be selectively adjustable vertically to accommodate varying heights of partial piles (19*a*).

* * * * *